United States Patent [19]

Barlow et al.

[11] 4,230,314

[45] Oct. 28, 1980

[54] SKATE BOARD GAME

[75] Inventors: Gordon A. Barlow, Evanston; John R. Krutsch, Glenview, both of Ill.

[73] Assignee: Gordon Barlow Design, Skokie, Ill.

[21] Appl. No.: 950,741

[22] Filed: Oct. 12, 1978

[51] Int. Cl.[3] ..... A63F 9/14

[52] U.S. Cl. ..... 273/1 E; 273/1 R

[58] Field of Search ..... 273/1 R, 1 E, 1 M; 35/22 R, 11 R

[56] References Cited

U.S. PATENT DOCUMENTS 943,567 10/1948 Spear et al. ..... 273/1 E

*Primary Examiner*—Paul E. Shapiro

*Attorney, Agent, or Firm*—Alter and Weiss

[57] ABSTRACT

A unique skate board game wherein a pair of players individually steer miniature skate boards mounted over a moving tape having a plurality of randomly placed and randomly shaped apertures thereon, attempting to avoid the apertures. The skate boards include bottomless containers having pellets therein which drop through the apertures, if the players fail to avoid the apertures as the tape passes under the skate board.

10 Claims, 4 Drawing Figures

SKATE BOARD GAME

This invention is concerned with game devices; and more particularly, with game devices wherein two players can compete.

There are a great many different types of games available in the marketplace. Some are learning type games; while others test some motor skills of the players. The motor skill testing type games are interesting in that they generally include automatic moving parts that add a dynamic aspect to the game. The amusement value of the dynamic aspect is increased when it is decorated to appeal to the imagination of the player.

The game becomes even more interesting and attention holding to many players, when it is possible to engage in the game competitively. The amusement value is even further enhanced when the controls used during playing the game are related to some well known and desired control devices.

Accordingly, it is an object of the present invention to provide new and unique game devices.

A related object of the present invention is to provide a box type game wherein the player utilizes motor skills; i.e., the player's dexterity is tested during playing of the game.

Another object of the present invention is to provide box type games, requiring dexterity of the players, having moving parts thereon with the movement of some of the parts under the control of the player using a steering wheel type device.

Still another object of the present invention is to provide games having moving parts thereon under the control of the player wherein two players can simultaneously play the game competitively.

Yet another object of the present invention is to provide competitive type box games having moving parts thereon requiring dexterity on the part of the players wherein the skill level can be adjusted.

In accordance with a preferred embodiment of the present invention a pair of miniature skate boards are each mounted to pivot around one end. A moving tape is provided which continually moves under the other or free end of the skate board. The moving tape has a plurality of randomly placed and randomly shaped apertures therein.

The other end of the skate boards; i.e., the free, non-pivoted end, has mounted thereon containers which are actually bottomless and have pellets, such as marbles, therein so that as any of the apertures pass under the skate boards, the marbles will drop through the aperture to a container built in the box containing the game. Each player is provided with a control means such as a steering wheel for enabling the player to pivot the skate board and avoid the apertures.

These and other objects and features of the invention together with the manner of obtaining them will be best understood by making reference to the accompanying drawings, wherein.

Figure 1:
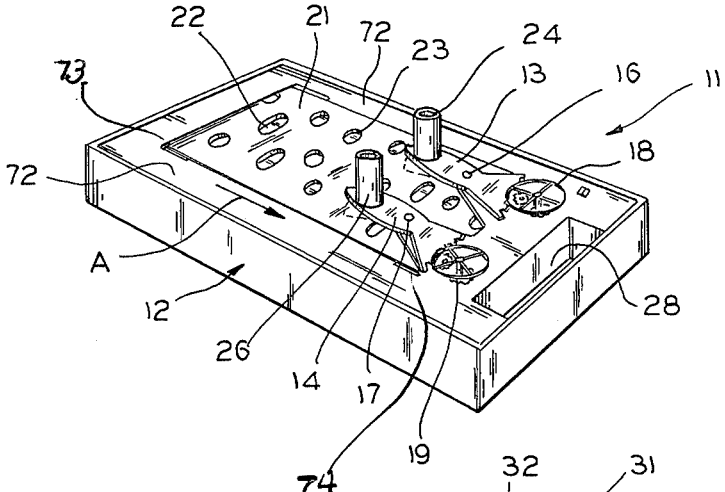
FIG. 1 is a pictorial view of the inventive skate board device.

The pictorial view of FIG. 1 shows the inventive skate board device 11. The device is preferably provided in a box, a portion of which serves as the base; for example, base 12 is the bottom of the box in which the device is furnished. The game includes the skate boards 13 and 14 which are each mounted to pivot around pivot means, such as pivot posts 16 and 17.

Means are provided for controlling the amount that the skate boards 13 and 14 pivot. More particularly, steering wheels 18 and 19 are manipulated by individual players to control the individual boards 13 and 14.

The game features a moving tape 21 having a plurality of randomly placed and randomly shaped apertures, such as apertures 22 and 23. The tape is mounted to move towards the board in the direction of the arrow A. Thus, the players can see the apertures as they move towards the skate boards, and can steer to avoid the apertures.

Means are provided for indicating when the skate board has not avoided an aperture. More particularly, mounted to the end of each skate board is shown a hollow cylindrical tube, such as storage tubes 24 and 26. These tubes are bottomless and are extensions of holes passing through the skate boards.

Figure 4:
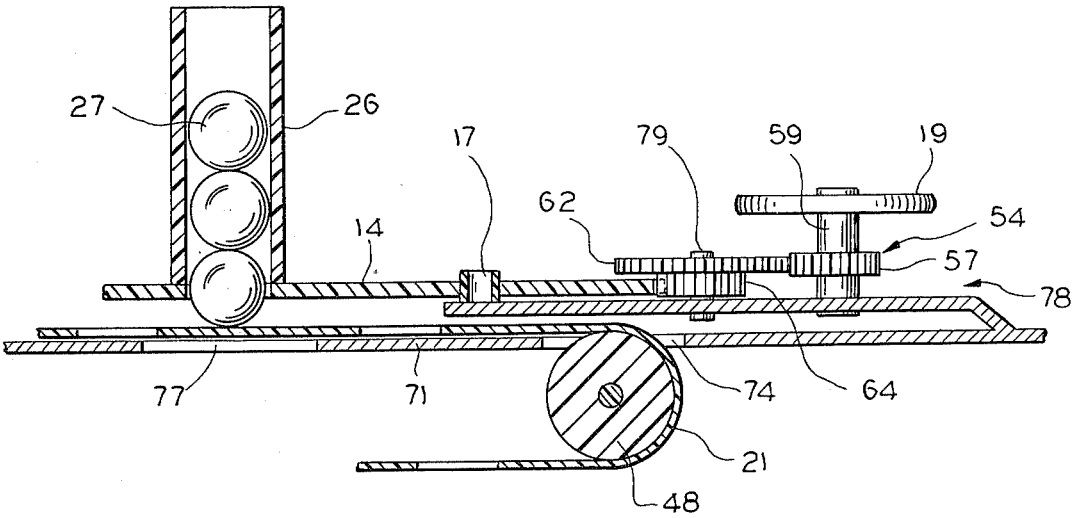
FIG. 4 is a sectional view of that portion of FIG. 3 defined by the arrows 4—4 and looking in the direction of the arrows 4—4.

In the tubes are stored pellets, such as the marble 27 shown in FIG. 4. As long as the skate board is over a solid portion of the tape, the marbles are retained within the tube. However, when one of the apertures passes under the skate board, notwithstanding the manipulations of the player to avoid the aperture, then a marble drops through the aperture in the tape. Means, not shown, at the bottom of base 12, such as a ramp, for example, enlists the force of gravity to collect the marbles in groove 28 at one end of the skate board device.

Figure 2:
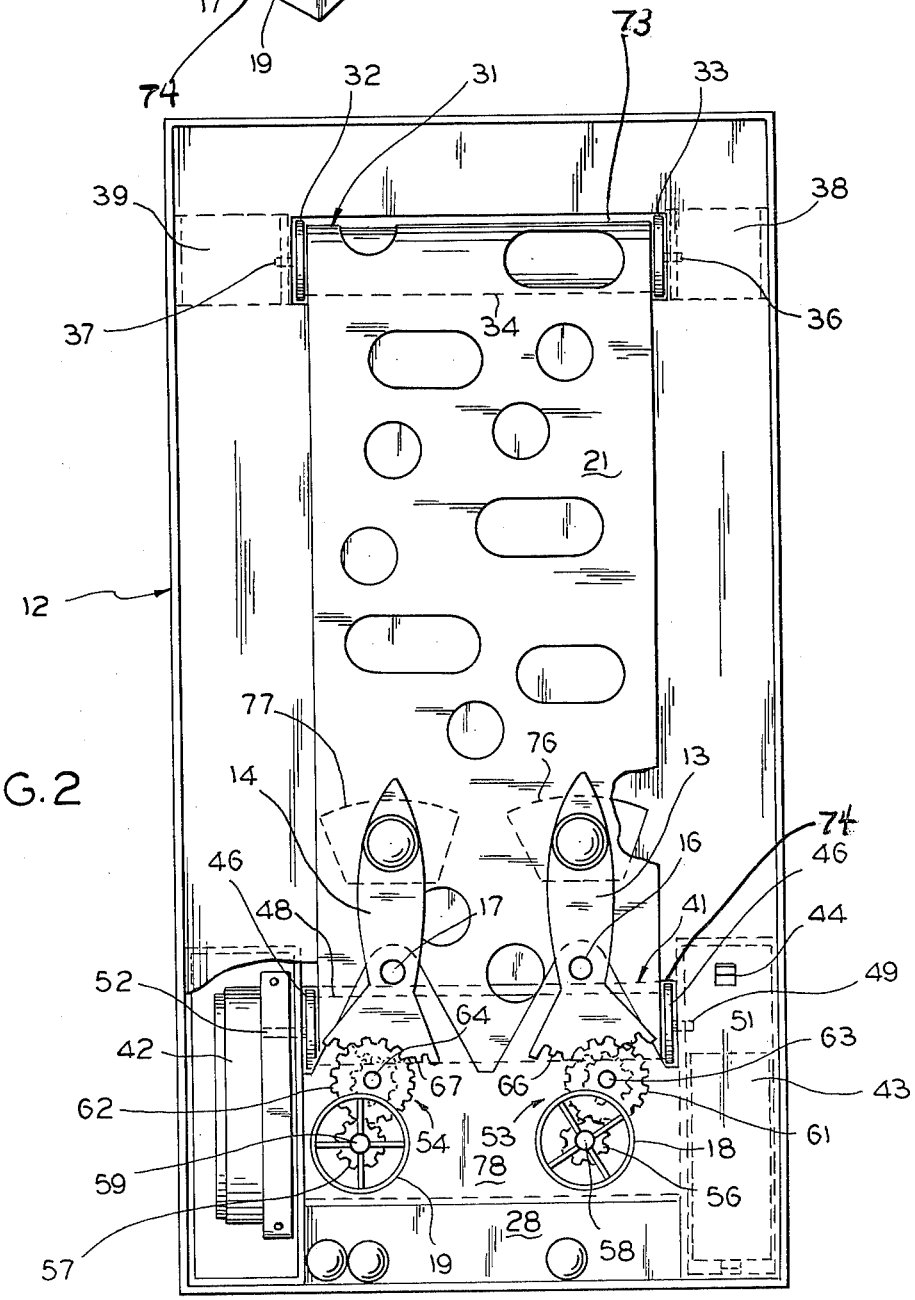
FIG. 2 is a plan view of the device of FIG. 1 with a partial cut-away portion.

As shown in FIG. 2, the far end of the tape 21 rotates around an idler roller 31 that comprises a pair of end flanges 32 and 33 enclosing a main body section 34. The roller includes axially extending mounting pins 36 and 37 at each end used to mount the roller in end blocks 38 and 39. The roller 31 is an idler which turns with tape 21.

The partially cut-away view at the skate board end of the box game shows means for motivating drive roller 41, such as motor means 42. The motor means shown in the preferred embodiment is an electrical motor driven by battery 43, responsive to the operation of a switch 44. It should be understood that motor 42 could be energized by springs or by alternating current electricity obtained from a normal electric socket without any detrimental effect on the inventive aspects of the skate board game.

Roller 41 also contains end flanges, such as end flanges 46 and 47, and a main body section 48 of a smaller diameter than the end flanges. The main body section 48 drives the tape 21 responsive to the rotation of the roller 41. A pivot pin 49 extends axially from one end of the roller 41 into pivot block 51. At the other end of roller 41 drive pin 52 extends from the motor and is coupled to the center of the roller 41.

Means are provided for coupling the steering wheels 18 and 19 to the skate boards. More particularly, gear trains 53 and 54 couple steering wheel 18 to skate board 16 and steering wheel 19 to skate board 14, respectively. The gear train includes spur gears 56 and 57 attached directly to the shafts 58 and 59 of steering wheels 18 and 19, respectively.

Spur gears 56 and 57 mesh with gears 61 and 62, respectively. Coaxial with gears 61 and 62 are spur gears 63 and 64, respectively. Spur gears 63 and 64 each mesh with the gear teeth 66 and 67 integral to skate boards 13 and 14, respectively. Thus, any movement of the steering wheel causes pivotal movement of the skate boards. Turning the steering wheel, for example, in a clockwise direction pivots the skate board in a counterclockwise direction around its pivot post.

Figure 3:
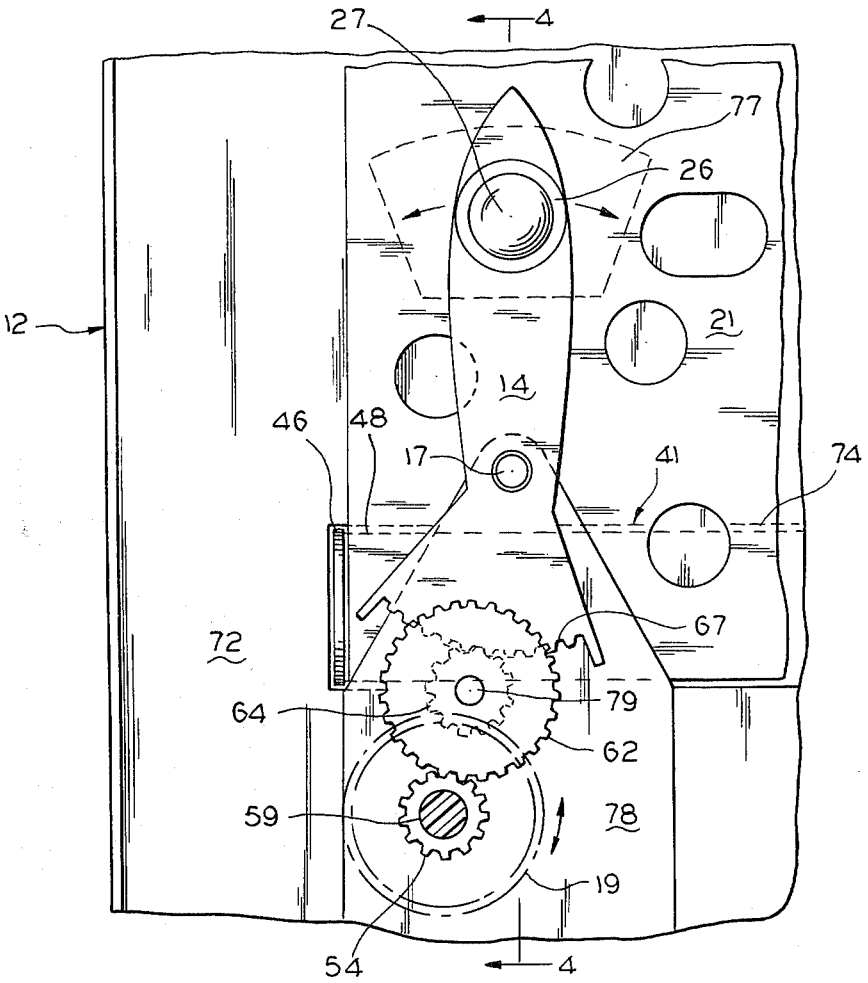
FIG. 3 is an enlarged showing of a portion of the plan view of FIG. 2.

The relationship of the gears, steering wheel and skate board, and the operation of the skate board relative to the apertures in the tape is best understood from FIGS. 3 and 4. As shown in FIG. 4, a support surface 71 extends under the tape from the sides of the box 12. The tape covers a large area of the support surface leaving a border area 72 uncovered.

Grooves are provided in the support surface 71 enabling the rollers 31 and 41 and the tape 21 to pass therethrough. The grooves are shown as grooves 73 and 74 associated with rollers 31 and 41, respectively.

Means are provided to enable the pellets or marbles to fall through the support surface 71 of the skate board game More particularly, a pair of characterized apertures 76 and 77 are provided under the apertured ends of the skate boards to enable the pellets or marbles which pass through the apertures in the tape to also pass through the supporting surface. For example, in FIG. 4 aperture 77 is shown mounted directly under storage tube 26 and skate board 14 to enable the marble shown resting on the tape 21 to drop through the support surface, when one of the apertures in the tape is directly under the storage tube 26.

The steering wheel 19 and gear mechanism 54 are shown mounted to a cantilevered section 78 extending from surface 71 of box 12. The cantilevered section 78 has the steering wheel shaft 59 pivotally mounted thereto in any well known manner which enables the steering wheel 19 to turn the shaft 59 and at the same time turn the spur gear 57. The spur gear 57 meshes with gear 62.

Thus, the rotation of gear 57 drives the gears 62 and 64. Gears 62 and 64 are mounted on a single shaft 79 that is pivotally mounted into the cantilevered section 78. The gear 64 meshes with gear teeth 67 integral to skate board 14. The pivot post 17 is fixedly mounted to cantilevered section 78, and the skate board is pivotally mounted to post 17. The skate board is caused to rotate about pivot post 67, responsive to the rotation of steering wheel 19.

Channels may be provided for receiving the pellets or marbles as they fall through the apertures and returning them to the groove 28 utilizing gravity by properly slanting the channels; or the marbles can be left to fall through the apertures at the bottom of the tape using gravity. From that point, because of the slant of a false bottom or ramp in the box the marbles return to groove 28.

The speed of the motor can be adjusted to provide different skill levels in manipulating the skate board to avoid the apertures.

The game is played by placing a plurality of marbles in each of the storage tube at the end of the skate board. The motor is turned on and the tape starts to move. Each of the players manipulates his skate board in an attempt to avoid the apertures. The first player to lose all of his marbles from the tube by failing to avoid the apertures, loses the game.

In the preferred embodiment the skate board appearance is enhanced by mounting a figure of a person on a skate board and disguising the cylinder as a series of containers.

While the principles of the invention have been described above in connection with specific apparatus and applications, it is to be understood that this description is an example only and not a limitation on the scope of the invention.

We claim:

1. A skate board game comprising:
an endless tape;
apertures in said endless tape;
at least one miniature skate board mounted on said endless tape;
means for moving said endless tape past said at least one miniature skate board;
means for steering said at least one miniature skate board to avoid aligning portions of said at least one miniature skate board with said apertures;
a storage container on said at least one miniature skate board;
pellets stored within said storage container; and
means to enable said pellets to fall from said storage container through said apertures in said endless tape when said storage container on said one miniature skate board and said apertures are aligned.

2. The skate board game of claim 1 comprising a boxtype base unit, and
means for mounting said endless tape in said base unit.

3. The skate board game of claim 2 wherein said endless tape comprises a drive roller at one end of said base unit and an idler roller at the other end, and
motor means for driving said drive roller.

4. The skate board game of claim 3 wherein said means for steering said at least one miniature skate board comprises a miniature steering wheel, and
means for coupling one end of said steering wheel to said at least one miniature skate board to cause the other end of said at least one miniature skate board to describe an arc responsive to rotation of said steering wheel.

5. The skate board game of claim 4 wherein said base includes a top surface, and
said endless tape passing over and under a portion of said top surface.

6. The skate board game of claim 5 wherein top surface apertures are provided to enable pellets from said storage container falling through the apertures in said endless tape to also pass through said top surface.

7. The skate board game of claim 6 including a cantilevered surface extending over said endless tape from a portion of said top surface not covered by said endless tape, and
means for pivotally coupling both said steering wheel and said at least one miniature skate board to said cantilevered surface.

8. The skate board game of claim 7 wherein said means for steering said skate board further includes gear teeth integral to the end of said at least one miniature skate board, and
gear train means extending from said steering wheel means to said integral gear teeth.

9. The skate board game of claim 1 including a pair of steering wheels and a pair of skate boards.

10. A method for two players to competitively play a skate board game using the skate board game of claim 9, said method comprising the steps of:
putting pellets in said storage container in both of said skate boards;

causing said endless tape to move towards said pair of skate boards;

each player steering his individual skate board to avoid the apertures and thereby not enable the pellets to fall from the storage containers; and winning by having pellets in the storage container, when the other player has no pellets remaining in the storage container.

* * * * *

UNITED STATES PATENT AND TRADEMARK OFFICE

CERTIFICATE OF CORRECTION

PATENT NO. : 4,230,314

DATED : October 28, 1980

INVENTOR(S) : Gordon A. Barlow, et al.

It is certified that error appears in the above-identified patent and that said Letters Patent are hereby corrected as shown below:

| | |
|---|---|
| Column 4, Line 41 | After "base" insert the word--unit--. |

Signed and Sealed this

*Seventh* Day of *April 1981*

[SEAL]

*Attest:*

RENE D. TEGTMEYER

*Attesting Officer*

*Acting Commissioner of Patents and Trademarks*